United States Patent [19]

Voris

[11] 4,358,108

[45] Nov. 9, 1982

[54] APPARATUS FOR EXERCISING THE HAMSTRING OR QUADRICEP MUSCLE GROUPS

[75] Inventor: Harvey C. Voris, Rancho Palos Verdes, Calif.

[73] Assignee: Paramount Health Equipment Corporation, Los Angeles, Calif.

[21] Appl. No.: 271,480

[22] Filed: Jun. 8, 1981

[51] Int. Cl.[3] ..... A63B 21/06

[52] U.S. Cl. ..... 272/118; 272/DIG. 4; 272/134

[58] Field of Search ..... 272/117, 118, 134, 138, 272/139, 141, DIG. 4, 130, 144

[56] References Cited

U.S. PATENT DOCUMENTS 4,256,302 3/1981 Keiser et al. ..... 272/118

4,322,071 3/1982 Lambert et al. ..... 272/118

*Primary Examiner*—Richard C. Pinkham

*Assistant Examiner*—William R. Browne

*Attorney, Agent, or Firm*—Nilsson, Robbins, Dalgarn, Berliner, Carson & Wurst

[57] ABSTRACT

A combined exercise apparatus has a frame, a structure for locating at least one knee of a user relative to the frame when the user is in either a sitting or a standing position, and a mechanism for engaging and resisting pivotal movement of the lower leg of the user. The engaging and resisting means includes at least one pivot arm engageable with the lower leg of the user and suspended for pivotal movement about a machine axis parallel to the joint axis of the knee, the location of the machine axis being adjustable to substantially coincide with the joint axis of the user's knee when the user is in either the sitting or the standing position.

17 Claims, 11 Drawing Figures

FIG. 3
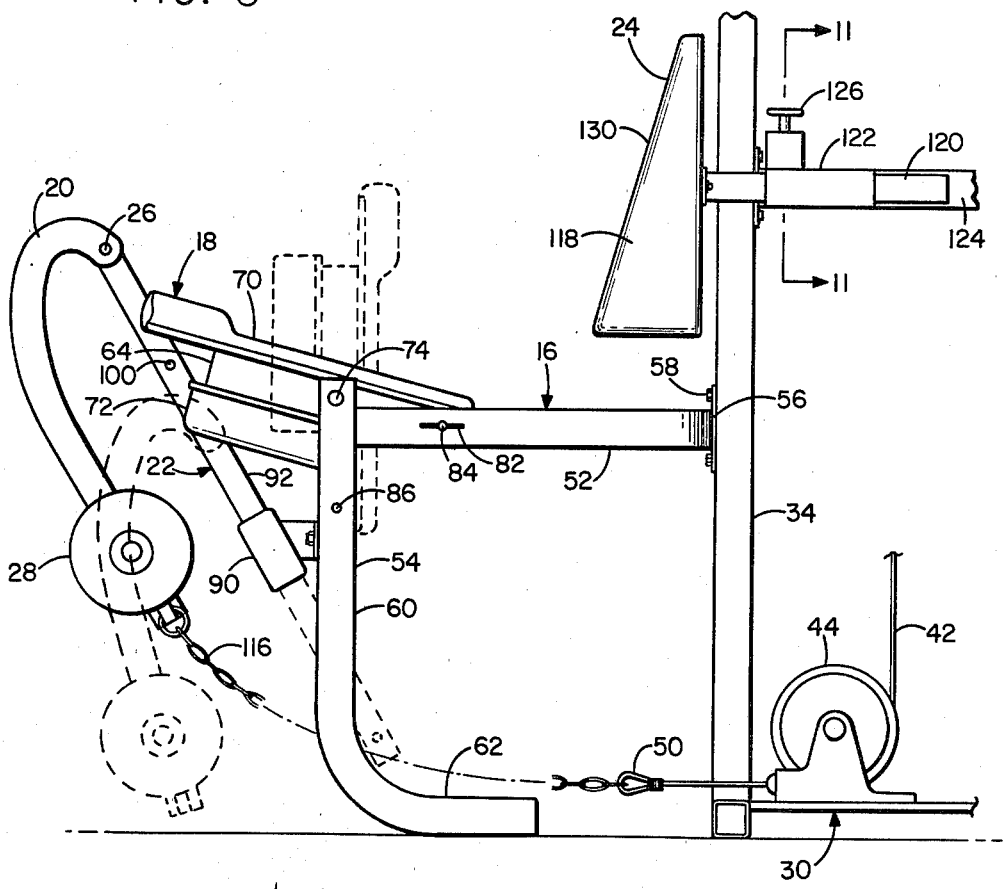
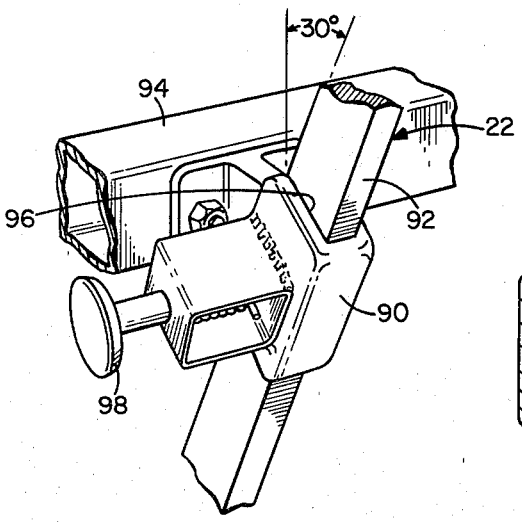
FIG. 9
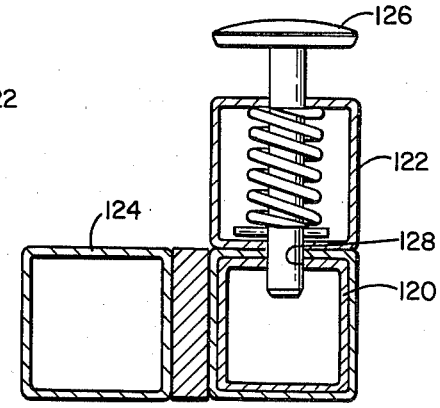
FIG. 11

APPARATUS FOR EXERCISING THE HAMSTRING OR QUADRICEP MUSCLE GROUPS

BACKGROUND OF THE INVENTION

This invention relates generally to the exercise art, and more particularly to a novel combined apparatus for exercising primarily either the hamstring or quadricep muscle groups of a user.

There have been weight resistance exercise machines able to exercise the hamstring and quadricep muscle groups of a user. However, such prior machines have commonly incorporated separate stations or submechanisms suited to individually exercise these two important muscle groups. For example, a chair and fixed pivot bar arrangement has been provided for performing leg extension exercises which develop the muscles in the quadricep group. A user seated in the chair engages the pivot bar with his lower leg and straightens the leg upwardly to a horizontal condition against the force of the machine. A separate thigh pad and pivot bar arrangement is then used for performing leg curl exercises which develop the hamstring muscles. The user stands before a pair of thigh pads and bends his lower leg backwardly to a horizontal condition.

Machines having separate stations for exercising the quadriceps and hamstrings not only take up an inordinate amount of space, but are also rather expensive to manufacture. These factors become critical in machines designed for use in the the home because the average home user has only a limited amount of space and money which he is willing to allocate to an exercise machine. The characteristics of machines having separate stations thus virtually preclude use of such machines in most homes.

A further limitation of prior machines having separate leg extension and leg curl stations is an inability to adjust the chair arrangements thereof to accommodate users having different femur lengths. It is therefore possible for a user having an unusually long or short femur to be positioned such that the axis of the pivot bar is spaced a substantial distance from the joint axis of the user's knee. This nonaligned condition of the machine and joint axes causes the machine arm and the user's leg to trace different arcs during an exercise. The roller at the end of the arm then rides up and down the leg, producing different conditions of leverage between the leg and the machine arm. Since the effective resistance to movement of the machine arm is dependent on the leverage condition between the leg and the arm the resistance felt by the user will also undesirably vary during the course of the exercise. Additionally, the roller can sometimes roll downwardly off the foot of the user releasing the pivot bar and possibly causing injury.

Some exercise machines have brought two stations together about a single bench for the purpose of performing leg extension and leg curl exercises. In machines of this type, two arms are connected perpendicularly for pivotal movement about a single fixed axis at the end of the bench. One of the pivot arms initially extends downwardly from the fixed axis while the other extends horizontally therefrom. Leg extension exercises are performed by a user sitting at the end of the bench and straightening his leg to raise the downwardly extending bar to a horizontal condition. Leg curl exercises are performed by the user lying face down on the bench and bending the lower leg upwardly to raise the horizontal arm to a vertical condition.

Machines of this second type are also rather bulky due to the two perpendicular pivot arms and the accompanying bench. In use, the bench is directed outwardly from the remainder of the exercise machine, with the perpendicular arms mounted to the outer end thereof. This configuration therefore aggravates the bulkiness of the assembled machine. There is also no assurance that the machine axis in this case will correspond to the joint axis of the user's knee because the joint axis is dependent entirely on the positioning of the user on the bench. Furthermore, the machine provides no back support for the user in a sitting position and requires the user to assume an awkward face down position for leg curls.

Therefore, it is desirable to provide an apparatus for performing leg extension and leg curl exercises at a single station of an exercise machine while maintaining the machine axis of the engaging pivot arm substantially at the joint axis of the user's knee.

SUMMARY OF THE INVENTION

The present invention comprises an apparatus for exercising primarily either the hamstring or quadricep muscle groups of a user by performance of leg curl or extension exercises, respectively. A frame is provided in conjunction with means for locating at least one knee of a user relative to the frame and means for engaging the lower leg of the user below the knee and resisting pivotal movement of the lower leg thereabout in a direction outwardly and upwardly relative to the frame. The locating means is mounted to the frame for rotation from a first condition for supporting the posterior portion of the user's thigh in a sitting position to a second condition for bracing the anterior portion of the thigh in a standing position. The engaging and resisting means includes at least one arm engageable with the lower leg of the user and means for suspending the arm for pivotal movement about a machine axis substantially parallel to the joint axis of the knee. The suspending means itself includes means for adjusting the height of the machine axis relative to the frame. The machine axis can thus be adjusted to substantially the height of the joint axis of the user's knee when the user is in either the sitting or the standing position.

The first and second conditions of the locating means may be substantially horizontal and substantially vertical, respectively, and the axis of rotation of the locating means may be parallel to the pivot axis of the arm.

The means for adjusting the height of the machine axis relative to the frame may take the form of means for simultaneously adjusting both the height of the machine axis and the horizontal placement thereof outwardly from the frame such that the machine axis can be adjusted to substantially coincide with the joint axis of the user's knee when the user is in either the sitting or the standing position. This structure may take the form of a brace mechanism supporting the arm at the machine axis and actuable between at least two conditions of extension in a direction outwardly and upwardly relative to the frame. The conditions of extension correspond to locations of the first axis which substantially coincide with the joint axis of the user's knee when the user is in the sitting and the standing positions, respectively. The retaining bracket can be angled outwardly and upwardly relative to the frame such that the direction of extension of the adjusting means is inclined outwardly approximately 30 degrees from the vertical.

A portion of the arm may also be curved through an angle of over 90 degrees adjacent the machine axis, the curved portion extending generally outwardly from the machine axis and curving generally downwardly therefrom to eliminate the possibility of pinching a user's hand between the arm and the brace when the height of the first axis is being adjusted.

The apparatus of the present invention provides a single station of an exercise machine enabling either leg extension or leg curl exercises to be performed with the pivotal axis of the machine substantially coinciding with the joint axis of the user's knee. Leg extension exercises are performed with the locating means in a substantially horizontal condition for use as a seat bottom. The pivoting arm is then repeatedly actuated outwardly and upwardly relative to the frame. In this condition, the pivoting arm is positioned to locate the machine axis substantially at the joint axis of the user. Leg curl exercises are performed with the locating means in a substantially vertical condition for bracing the anterior portion of the user's thigh in a standing position. The locating means is placed in this condition by rotation through an angle of approximately 90 degrees relative to the frame. At the same time, the location of the machine axis is adjusted downwardly to place it substantially at the joint axis of the knee. The machine axis of the apparatus is thus maintained substantially at the joint axis of the user's knee in both the leg extension and leg curl modes. The roller or other leg engagement device at the lower end of the pivoting arm therefore remains substantially stationary relative to the leg throughout the range of pivotal motion, producing more uniform resistance to motion of the user's leg than would otherwise be the case and eliminating the possibility of a roller traveling off the end of the user's foot.

The apparatus of the present invention also solves the physical size problem noted above in relation to prior exercise machines, permitting storage and use of the machine of the present invention at a user's residence or other confined location. The simplicity and compactness of the apparatus also reduce the cost of manufacture, making the apparatus more affordable to a potential home user.

The unique structure of the present apparatus achieves these results without sacrificing the operational advantages of machines having separate stations for performing leg extension and leg curl exercises. That is, a full seat assembly is provided for supporting the user during leg extension exercises, including a seat back for locating and fully supporting the back of the user. Further, the seat back is adjustable fore and aft to compensate for users of different femur lengths. The femur length and overall height of a user thus have no effect on the proper operation of the apparatus for performance of leg extension exercises. The apparatus of the present invention also permits the user to perform leg curl exercises in a comfortable standing position rather than the awkward face down position encountered in some machines.

Adjustability of the machine axis relative to the frame is accomplished by sliding engagement of a brace element with a retaining bracket. Because the retaining bracket is angled outwardly and the brace element is essentially linear, extension or retraction of the brace element relative to the retaining bracket serves to simultaneously adjust the height and horizontal placement of the machine axis.

The precise locations of the machine axis in the leg extension and leg curl modes of operation are determined using available statistically derived anthropometric data for adult males falling within the 50th percentile from the standpoint of physical size.. The data is applied to the geometric configuration of the apparatus to locate the approximate joint center of a user's knee, and the machine axis is positioned as close as possible thereto. For these purposes, the joint centers of the user's knees and ankles are assumed to be at the centers of the respective knee and ankle masses. The distances to either side of a particular joint mass are thus found from the published data, and these distances are averaged to arrive at the distance to the joint center.

BRIEF DESCRIPTION OF THE DRAWINGS

The above and other objects of the present invention may be more fully understood from the followng detailed description taken together with the accompanying drawings wherein similar reference characters refer to similar elements throughout and in which:

FIG. 3 is a side elevational view of the assembly of FIG. 2, illustrating the transition of the assembly from a first condition for performance of leg extension exercises to a second condition for performance of leg curl exercises;

FIG. 9 is a perspective view, partially broken away, showing the retaining bracket of the assembly of FIG. 2;

FIG. 11 is a vertical sectional view taken along the line 11—11 of FIG. 3.

DESCRIPTION OF THE PREFERRED EMBODIMENTS

Figure 1:
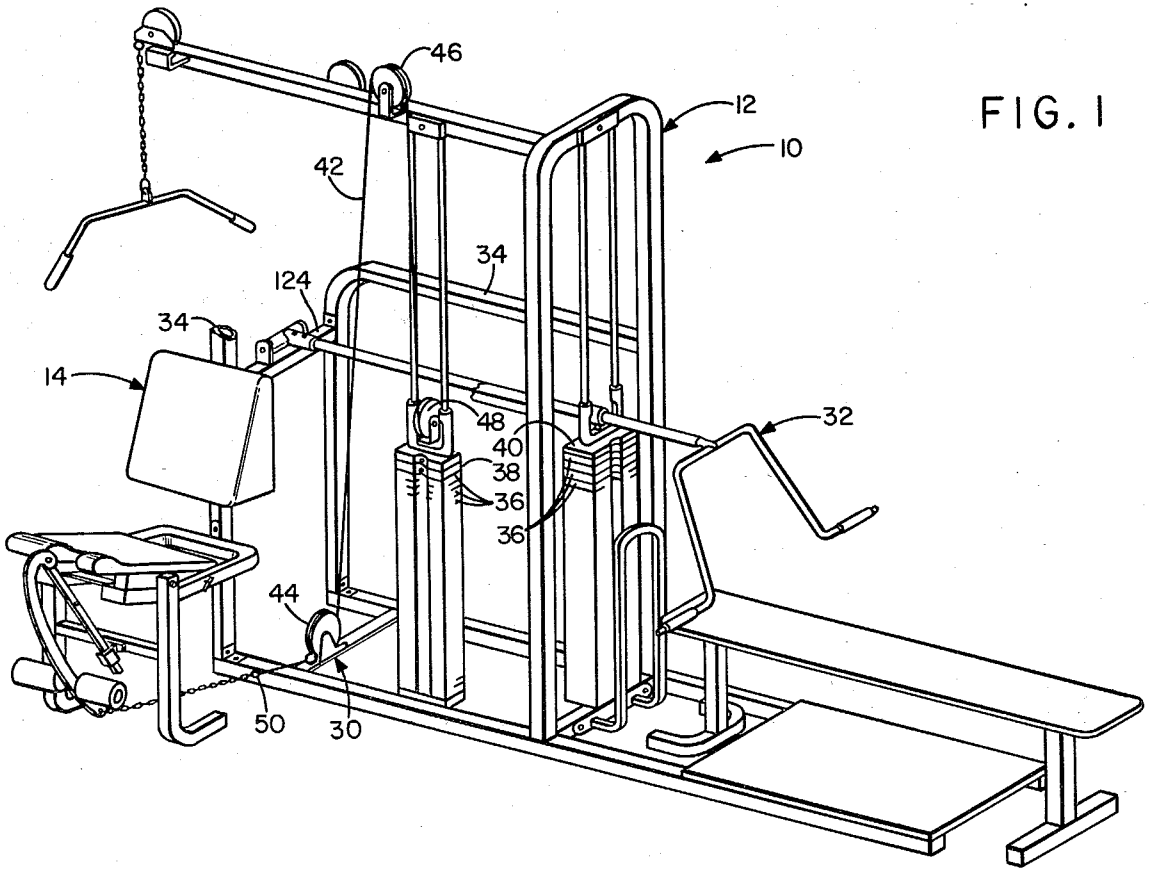
FIG. 1 is a perspective view of an apparatus constructed in accordance with the present invention.
Figure 2:
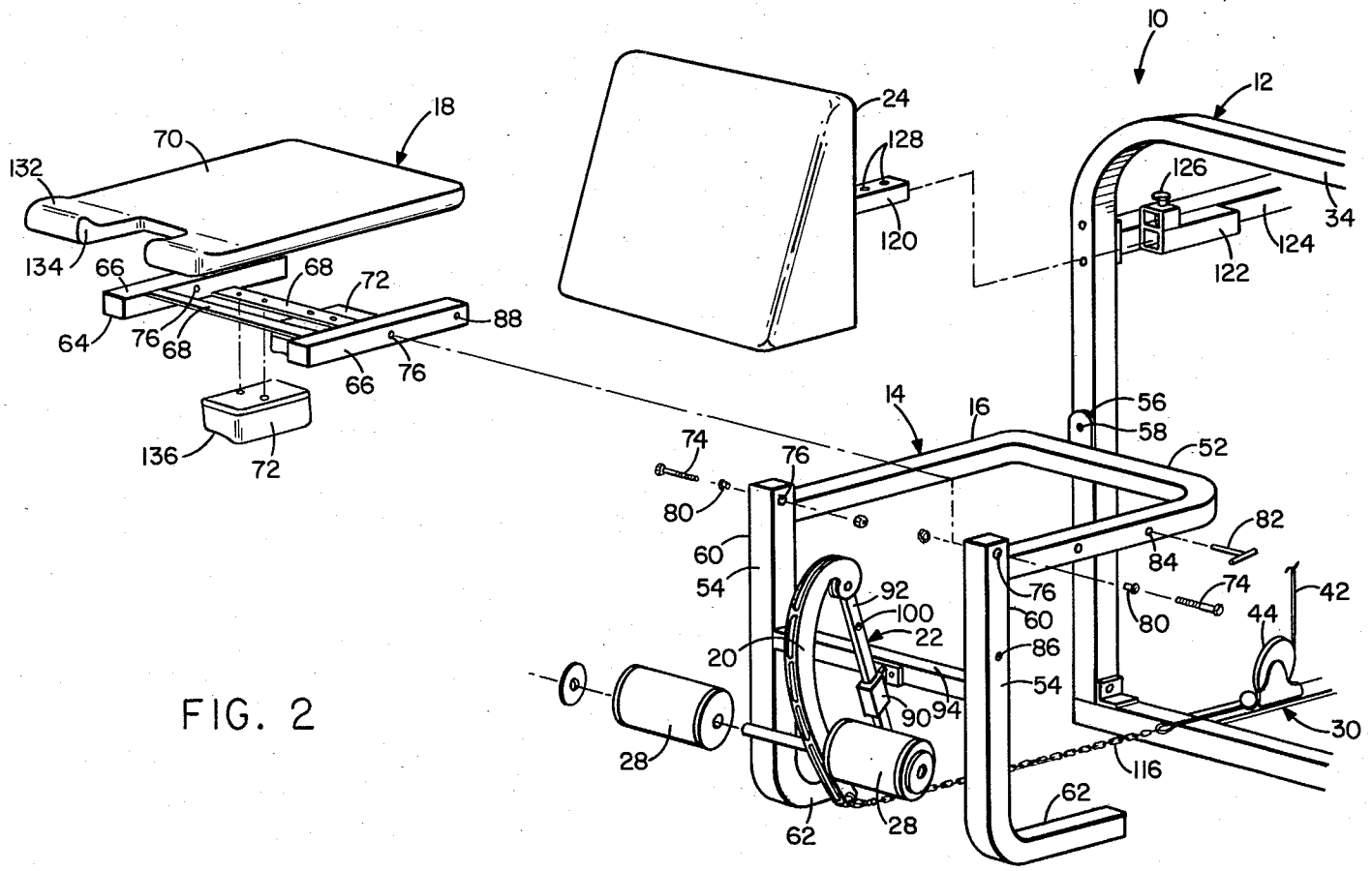
FIG. 2 is a fragmentary enlarged exploded perspective view of the apparatus of FIG. 1, showing a leg extension/leg curl assembly thereof.

Referring now to the drawings, there is illustrated, in FIGS. 1 through 3 thereof, an apparatus embodying the present invention, generally designated 10. The apparatus 10 includes a weight resistance exercise machine 12 having an assembly 14 attached thereto for performance of leg extension and leg curl exercises. The assembly 14 comprises a main frame 16, a locating structure 18 mounted for rotation within the main frame 16, a pivot arm 20 suspended from a longitudinally adjustable brace mechanism 22, and a seat back arrangement 24.

As seen in relation to FIG. 3, the locating structure 18 is rotatable from a first substantially horizontal condition shown in full lines in FIG. 3 to a second substantially vertical condition shown in broken lines. Similarly, the pivot arm 20 and an associated machine axis 26 between the pivot arm and the brace mechanism 22 are actuable longitudinally of the brace mechanism 22 between an upper condition shown in full lines in FIG. 3 and a lower condition shown in broken lines. For purposes of the following discussion, the full line conditions of the locating structure 18 and the pivot arm 20 in FIG. 3 correspond to a first condition of the assembly 14 and the broken line conditions of these elements in FIG. 3 correspond to a second condition of the assembly 14.

Figure 4:
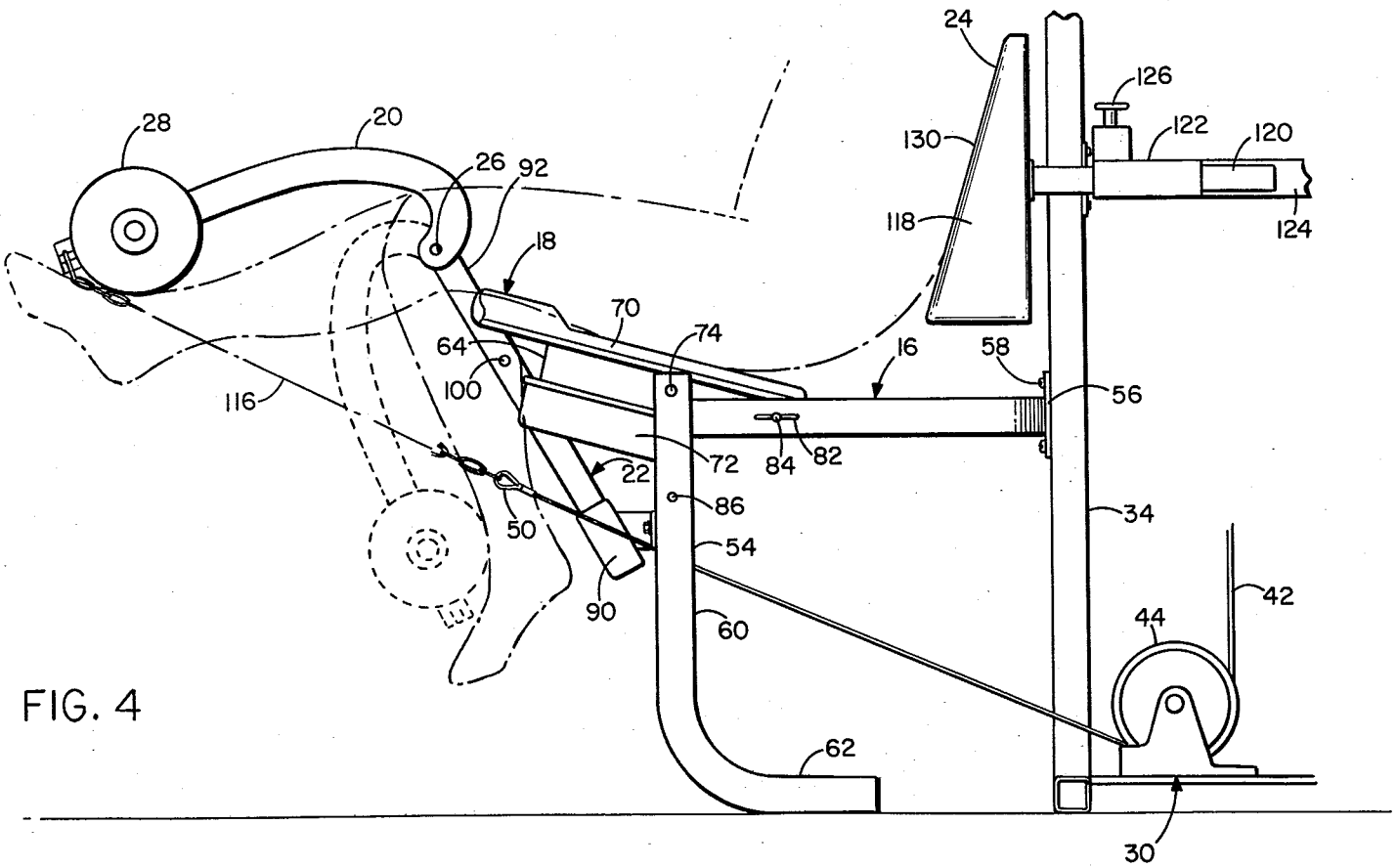
FIG. 4 is a side elevational view showing the assembly of FIG. 2 during performance of a leg extension exercise.

In the first condition of the assembly 14, the locating structure 18 is adapted to support the posterior portions of a user's thighs, with the lower legs of the user tucked behind a pair of rollers 28 as shown in FIG. 4. The user then exercises primarily the quadricep muscle group by repeatedly extending his lower legs outwardly and upwardly relative to his knees and against the resistive force of the pivot arm 20.

When it is desired to exercise primarily the hamstring muscle group, the assembly 14 is placed in the second condition by rotation of the locating structure 18 and lowering of the pivot arm 20 to the broken line conditions shown in FIG. 3. The locating structure 18 is then able to support the anterior portions of the user's thighs, with the user's ankles tucked behind the rollers 28 in the manner of FIG. 8. Leg curl exercises for developing the hamstring muscle group are performed by moving one of the lower legs backwardly and upwardly about the knee thereof and against the resistive force of the pivot arm 20.

Figure 7:
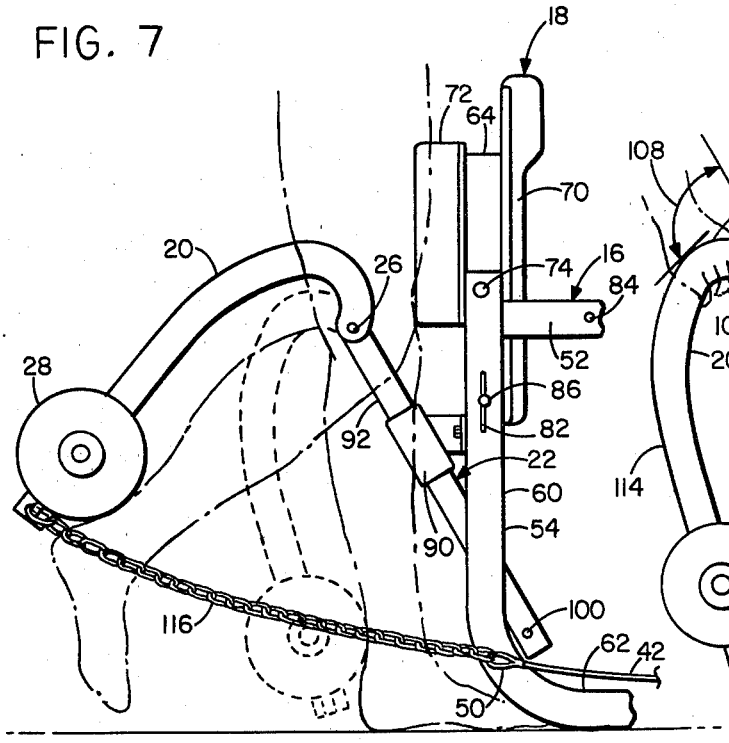
FIG. 7 is a side elevational view of the assembly of FIG. 2 during performance of a leg curl exercise.

As seen clearly in FIGS. 4 and 7, the assembly 14 is easily actuable between two distinct conditions or modes of operation for performing two entirely different exercises. At the same time, it is apparent that the machine axis 26 coincides with the joint axis of the user's knees throughout the range of motion in each condition. Consequently, the rollers 28 engage substantially the same portion of the user's lower leg during the course of an exercise, rather than riding up or down on the leg.

Referring to the drawings in greater detail, the exercise machine 12 of FIG. 1 may be of any conventional construction having a low pulley station 30. The machine 12 shown has a press bar station 32 in addition to the low pulley station. The mechanisms of the low pulley station 30 and the press bar station 32 are located essentially between side rails 34 of the machine 12 and are operable to raise and lower a preselected number of weights 36 in weight stacks 38 and 40, respectively. The low pulley station 30 comprises a cable or other flexible force transmitting member 42 engaging a low pulley 44, a high pulley 46 and a traveling pulley 48, to raise the weights 36 of the stack 38. The low pulley 44 and a lower end 50 of the cable 42 extend outwardly relative to one of the side rails 34 for connection to the assembly 14.

Referring now to FIGS. 2 through 5, the main frame 16 is made up primarily of a "U"-shaped member 52 having a pair of "L"-shaped members 54 attached to the ends thereof. The closed end of the U-shaped member 52 is provided with a flange 56 which is secured to one of the side rails 34 by a pair of bolts 58. The member 52 is directed along a horizontal plane and is connected at its free ends to the L-shaped members 54. The L-shaped members 54 are located along parallel vertical planes and are made up of upper legs 60 depending vertically from the member 52 and lower legs 62 supported horizontally by the surface of the floor. The lower legs 62 are directed backwardly from the upper legs 60 in the direction of the machine 12 to avoid interference with a user's feet.

The locating structure 18 comprises a pivot frame 64 having a pair of opposed tubular side members 66 connected by a pair of lateral braces 68. A cushioned seat platform 70 is attached to one side of the pivot frame 64 and a pair of cushioned thigh pads 72 are located on the opposite side of the frame. The pivot frame 64 is mounted for rotation relative to the main frame 16 by a pair of screws or other suitable pivot elements 74 extending through coaxial pivot openings 76 of the L-shaped members 54 to engage similar openings 78 of the pivot frame 64. The openings 76 and 78 may be provided with bushings or other suitable bearing elements 80 permitting free and accurate rotation of the pivot frame 64 relative to the main frame 16.

The locating structure 18 is thus pivotable between the substantially horizontal first condition shown in full lines in FIG. 3 and the substantially vertical second condition shown in broken lines. The locating structure is retained in one or the other of these conditions by a retaining pin 82 passed through either an opening 84 of the member 52 or an opening 86 of the member 54, and engaging a corresponding opening 88 in the pivot frame 64. As shown in the drawings, the pivot openings 76 are located on the L-shaped members 54 at locations slightly above the level of the U-shaped member 52. The openings 84 and 86 are then positioned centrally on the members 52 and 54, respectively, and are spaced uniformly from the openings 76 to cause the locating structure 18 to be angled upwardly from the horizontal in the first condition of the assembly 14 while being truly vertical in the second condition of the assembly. The optimum upward angle of the structure 18 in the first condition of the assembly has been found to be approximately 16 degrees from the horizontal. The user is then angled backwardly relative to the structure 18 and is supported at his back by the structure 24, raising his knees and legs off the ground. This not only permits use of the apparatus by persons having legs substantially longer than average, but also provides additional clearance beneath the locating structure 18 for retraction of the user's legs between extension exercises. As seen most clearly in FIG. 4, the user's lower leg is retracted substantially beneath the seat between extensions, forming an acute angle with his thigh. The greatest possible range of useful motion is thus attained during leg extension exercises.

Figure 10:
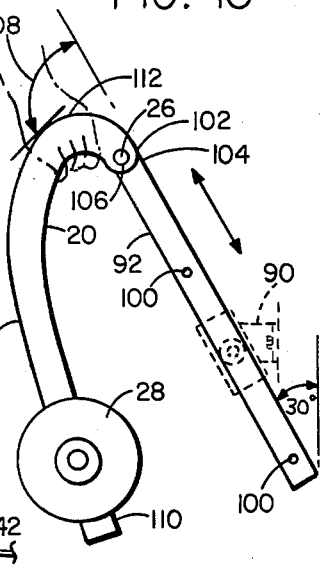
FIG. 10 is a side elevational view showing the pivot arm and brace element of the assembly of FIG. 2 when the location of the machine axis is being adjusted.

As seen in FIGS. 9 and 10, the longitudinally adjustable brace mechanism 22 includes a retaining bracket 90 for sliding reception of an elongated brace element 92 in at least two different conditions of extension. The bracket 90 is mounted to the mid-point of a tubular member 94 extending horizontally between the two L-shaped members 54. The brace element 92 is received within a slot 96 extending through the bracket 90 at an angle of 30 degrees with the vertical. The bracket 90 is thus designed to direct the brace element 92 upwardly and outwardly relative to the main frame 16. A spring loaded pin 98 of the bracket 90 is engageable with a plurality of openings 100 of the brace element 92 in the different conditions of extension thereof. In the embodiment illustrated, the brace element 92 has two poles 100 corresponding to the two conditions of extension of the brace mechanism 22. Adjustment between these two positions is accomplished by drawing the pin 98 outwardly relative to the bracket 90 in the direction indicated in FIG. 9 to release the pin from the corresponding opening 100 of the brace element 92. The brace element is then slid longitudinally to the other condition of extension thereof, at which point the second opening 100 will receive the pin 98 to lock the mechanism.

The configuration of the pivot arm 20 is shown most clearly in FIG. 10. An upper end 102 of the pivot arm 20 is connected to an upper end 104 of the brace element 92 by a pin or other pivot element 106 located along the machine axis 26. Adjacent the end 102, the arm 20 is curved through an angle 108 which is greater than 90 degrees, the curved portion of the arm extending generally upwardly and outwardly from the machine axis 26 and curving generally downwardly therefrom. The remainder of the pivot arm 20 is curved in the same general direction toward a lower end 110 thereof, but much more gradually. The arm 20 thus comprises a sharply curving upper portion 112 and a more gradually curving lower portion 114. The arm 20 and the brace element 92 are located along a common vertical plane extending through the center of the main frame 16. The rollers 28 extend outwardly from the arm 20 at a location adjacent the lower end 110 thereof in a direction generally perpendicular to the plane of the arm 20.

Extension and retraction of the brace element 92 relative to the bracket 90 is accomplished by a user grasping the curved upper end 112 of the arm 20 in the manner illustrated in FIG. 10. After withdrawing the pin 106 from one of the openings 100, the user simply urges the arm 20 in the direction indicated in FIG. 10, causing the brace element 22 to slide relative to the bracket 90. The curved configuration of the arm 20 permits the user to grasp the arm in this manner without pinching his hand between the arm and the brace element 92. With a curvature of over 90 degrees, any possibility of being pinched is eliminated.

Figure 5:
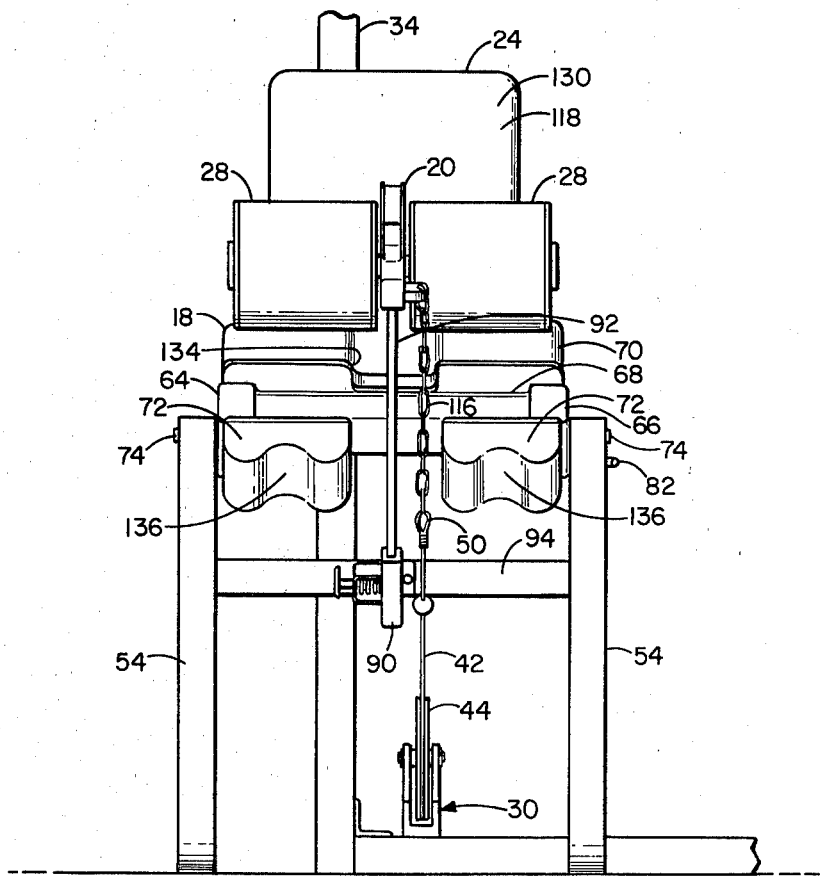
FIG. 5 is a front elevational view of the assembly of FIG. 4, with the pivot arm thereof in a fully extended condition.
Figure 6:
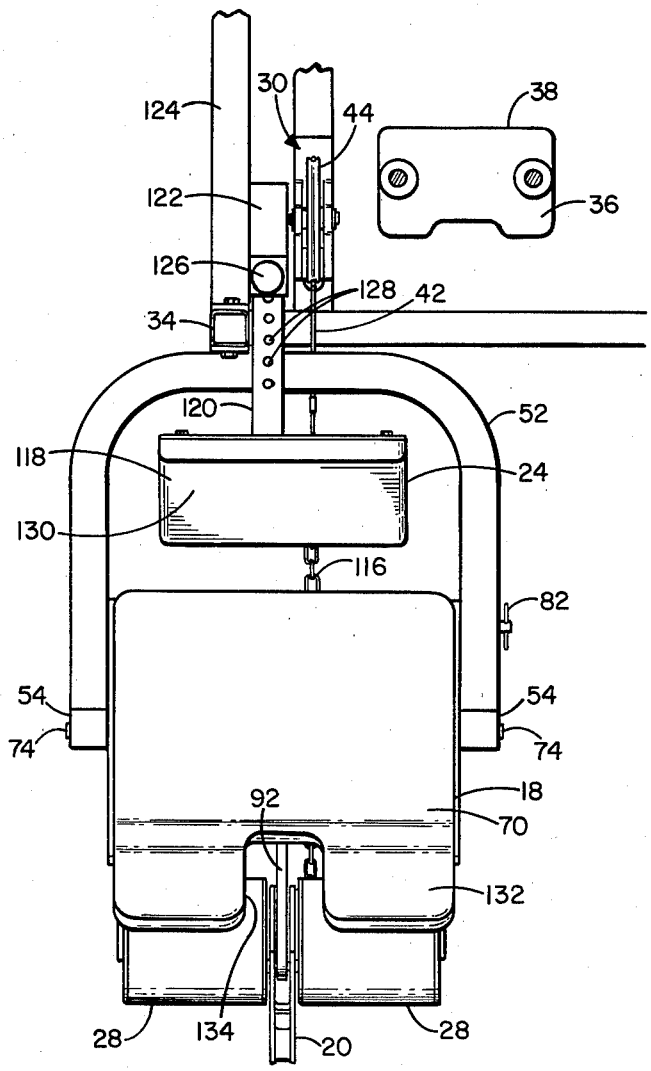
FIG. 6 is a top plan view of the assembly of FIG. 4.
Figure 8:
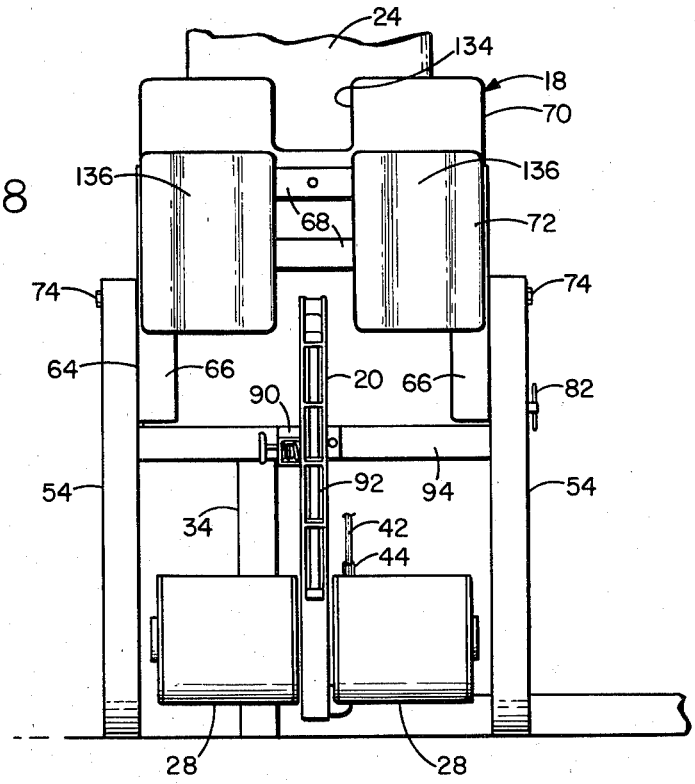
FIG. 8 is a front elevational view of the assembly of FIG. 7 at rest.

As shown in FIGS. 5, 6, and 8, the assembly 14 is offset a preselected distance from the centerline of the low pulley 44. The offset may be on the order of 2 inches and serves to prevent interference between the retaining bracket 90 and a chain or other flexible force transmitting member 116 connecting the lower end 110 of the pivot arm 20 to the lower end 50 of the cable 42. During the range of outward and upward motion of the arm 20 shown in FIG. 4, the lower end of the arm 20 and the chain 116 attached thereto are raised substantially above the retaining bracket 90. This would produce a serious interference problem between the chain 116 and the bracket 90 if the assembly 14 were centered on the low pulley 44. In the offset configuration of the present invention, however, the chain 116 and the lower end 50 are repeatedly brought to a position directly beside and out of contact with the bracket 90 when the arm 20 is fully actuated by a user. This condition is illustrated most clearly in FIG. 5 wherein the assembly 14 is in the first condition thereof.

The structure and adjustability of the seat back arrangement 24 is seen most clearly in FIGS. 3, 6 and 11. The arrangement 24 comprises generally a seat back cushion 118 having a tubular projection 120 extending horizontally backwardly therefrom and an adjusting bracket 122 mounted to a horizontal cross member 124 between the two side rails 34 of the exercise machine 12 (FIG. 1). The adjusting bracket 122 is provided with a spring loaded retaining pin 126 engageable individually with a plurality of spaced adjusting holes 128 in the upper surface of the projection 120. Adjustment of the force and aft position of the seat back cushion 118 can thus be accomplished by withdrawing the retaining pin 126 from one of the holes 128 and sliding the cushion 118 to the desired position before re-engaging the retaining pin.

As seen most clearly in FIGS. 3 and 4, the back cushion 118 is provided with a forward surface 130 which is slanted rearwardly at an angle of approximately 16 degrees with the vertical. The forward surface 130 of the cushion 118 is thus substantially perpendicular to the upper surface of the locating structure 18 in the first condition of the assembly. The cushion 118 provides optimum back support to a user in the tilted condition described above for performance of leg extension exercises.

The fore and aft adjustability of the seat back arrangement 24 serves to adapt the assembly 14 to the dimensions of a particular user. In the first condition of the assembly, it is important that the user be positioned on the locating structure 18 in such a manner that with the lower legs extending downwardly the forward edge of the seat platform 70 abuts the popliteal areas at the backsides of the knees. This condition is easily enough assumed by the user in the first instance, however, it is difficult to maintain during an exercise if adequate back support is not provided. Furthermore, any back support must be differently located for individuals of different femur lengths. The seat back cushion 118 is adjustable to the dimensional needs of a particular user, after which it serves as a supplementary locating device to assure that the joint axis of the user's knees is in position to substantially coincide with the machine axis 26.

The configuration of the cushioned seat platform 70 is important for proper support of the user's knees in the first condition of the assembly 14. As seen most clearly in FIGS. 2, 3 and 4, the seat platform 70 is provided with a raised portion 132 adjacent the front edge thereof for engaging the popliteal space at the back side of each knee. The raised portion 132 thus enhances the support of the user's thigh and knee, causing the joint axis of the knee to be more accurately and consistently located relative to the machine axis 26. As seen clearly in FIGS. 2 and 6, a central cutout 134 extends rearwardly into the seat platform 70 a distance approximately equal to the width of the raised portion 132. The cutout 134 provides clearance of the seat platform 70 relative to the pivot arm 20 and the brace element 92 when the locating structure 18 is rotated forwardly to the full line condition of FIG. 3.

Each of the thigh pads 72 is preferably provided with a longitudinal depression 136 on the outer surface thereof for reception of the anterior portion of a user's thigh in the broken line condition of FIG. 3. The depressions 136, seen most clearly in FIGS. 2 and 5, tend to center the thighs of the user relative thereto for optimum positioning of the user in the second condition of the assembly 14.

The various elements of the apparatus 10 can be made of any suitable material able to withstand the forces encountered during the course of leg extension and leg curl exercises. In particular, the U-shaped member 52, the L-shaped members 54 and the pivot frame 64 are preferably made primarily of steel tubing of either square or circular cross-section. The pivot arm 20 and the retaining bracket 90 may, however, be made of a suitable sand cast material such as aluminum for ease of fabrication. Such cast materials can be inexpensive and light in weight, and at the same time strong enough to exhibit a long service life as part of the apparatus 10.

In operation, a user desiring to perform a series of leg extension exercises must first insure that the assembly 14 is in the full line condition of FIG. 3. If not initially in this condition, the retaining pin 82 must be removed and the locating structure 18 must be rotated counterclockwise, as seen in FIG. 3, through an angle of 74 degrees. The pin 82 is then passed through the openings 84 and 88 to lock the locating structure in a substantially horizontal condition. Likewise, the pivot arm 20 must be raised to the full line condition of FIG. 3 by releasing the pin 98 of the bracket 90 and sliding the brace element 92 upwardly therethrough. The initial angular orientation of the pivot arm 20, and thus the initial position of the rollers 28, can be adjusted by increasing or decreasing the length of the chain 116. The effective length of the chain can be altered by disengaging the chain from the lower end 110 of the pivot arm 20 and reconnecting a different link of the chain to the end 110. Lastly, the seat back arrangement 24 should be adjusted to support the user's back when the user is seated on the platform 70 with the raised portions 132 abutting the popliteal spaces of his legs. The user then hooks his legs behind the rollers 28 in the manner shown in FIG. 4 and is prepared to perform leg extension exercises as indicated therein. The desired number of weights 36 from the weight stack 38 can be selected and engaged in the manner of weight resistance exercise machines generally.

When it is desired to perform leg curl exercises, the assembly 14 must be converted to the broken line condition of FIG. 3. This is accomplished by removing the retaining pin 82 to allow rotation of the locating structure 18 clockwise to a vertical condition and lowering the pivot arm 20. The retaining pin 82 is then engaged with the openings 86 and 88 to lock the locating structure in this position, and the retaining pin 98 is engaged with the upper opening 100 of the brace element 92. The adjustment of the seat back arrangement 24 need not be changed, however, it may be desirable to alter the effective length of the chain 116 to properly locate the rollers 28. This condition of the assembly 14 is shown in FIGS. 7 and 8. The user positions himself in the location of FIG. 7 with his legs tucked behind the rollers 28 and proceeds to execute leg curl exercises by individually pivoting his lower legs outwardly and upwardly relative to the assembly 14 in the manner indicated.

The structure described above thus provides an apparatus for locating the joint center of at least one knee of a user relative thereto in both a sitting and a standing position. The locations of the joint axis in the two positions of the user are spaced both vertically and horizontally from each other, and an extensible brace mechanism is provided for adjusting the machine axis of the pivot arm to substantially those locations. However, the assembly 14 will function in the intended manner only if the various elements thereof are sized appropriately to cause the machine and knee joint axes to substantially coincide. The appropriate sizes or dimensions of elements are, in turn, dependent upon the anatomical dimensions of the persons who are to use the assembly. In an apparatus of general applicability such as this, it is often advisable to dimension the elements of the apparatus for a person of average size. This is particularly important in the present case due to the crucial relationship between the machine axis and the knee joint axis of the user for optimum results. The assembly 14 will thus operate most effectively in the largest number of cases if the apparatus is dimensioned to ideally accommodate a user falling within the 50th percentile of a group of potential users on the basis of physical size. In that case, the machine axis will vary somewhat from the knee joint axis of the user, but the variation will usually be relatively slight and should not interfere with the advantageous operation of the assembly.

Anthropometric data showing various dimensions of human males in seated and standing positions may be obtained from engineering handbooks such as Human Engineering Guide to Equipment Design (1972 Edition, edited by Van Cott and Kinkade). The applicable data for a 50th percentile male can thus be obtained from published sources and applied to the structure described herein. The one dimension not directly available from published sources is the precise location of the joint axis of a knee or ankle within the knee or ankle itself. For purposes of machine design, it is possible to approximate the locations of these joint axes on the assumption that they are located at the centers of the corresponding joint masses. The dimensions of the 50th percentile male leading both up to and just beyond a particular joint can then be averaged to obtain the distance to the assumed joint axis. The vertical height of the knee joint axis of a 50th percentile male in a sitting position is thus obtained by averaging the height of the knee of a 50th percentile male in the sitting position (21.7 inches) and the height of the popliteal region of the 50th percentile male in the same position (17.1 inches) to obtain an average seated knee joint height of 19.4 inches. Since it can also be assumed that the user of the assembly 14 will be wearing shoes, an additional one inch can be added to this dimension. The dimension of 20.4 inches is thus suitable for use as the average height of a person's knee joint in determining the appropriate dimensions for the assembly 14. Similar calculations can be made to determine the approximate location of the ankle joint of a 50th percentile male.

As a result of calculations based on anthropometric data for a 50th percentile male, the following key dimensions of the assembly 14 have been arrived at to accommodate the largest number of potential users:

| | |
|---|---|
| Height of seat pivot (screws 74) | 23" |
| Angle of seat (above horizontal) | 16° |
| Height of spring loaded pin 98 of retaining bracket 90 | 15⅛" |
| Height of machine axis 26 in first condition of assembly 14 | 31" |
| Horizontal distance of machine axis 26 from seat pivot in first condition of assembly 14 | 13.7" |
| Height of machine axis 26 in second condition of assembly 14 | 20.4" |
| Horizontal distance of machine axis 26 from seat pivot in second condition of assembly 14 | 5.1" |
| Effective length of pivot arm 20 (machine axis 26 to axis of rollers 28) | 15" |
| Seat width | 18" |
| Seat length | 19" |

From the above, it can be seen that there has been provided an improved combined apparatus for performing leg extension and leg curl exercises while maintaining the machine axis of the mechanical pivot arm at substantially the same location as the joint axis of the user's knee.

What is claimed is:

1. Apparatus for exercising primarily either the hamstring or quadricep muscle groups of a user, comprising:
a frame;
means for locating at least one knee of a user relative to said frame, said locating means being mounted to said frame for rotation from a first condition for supporting the posterior portion of the associated thigh of the user in a sitting position to a second condition for bracing the anterior portion of the thigh in a standing position; and
means for engaging the lower leg of the user below the knee and resisting pivotal movement of the lower leg thereabout in a direction outwardly and upwardly relative to said frame, said engaging and resisting means including:
at least one arm engageable with the lower leg of the user; and
means for suspending said arm for pivotal movement about a machine axis substantially parallel to the joint axis of the knee, said suspending means including means for adjusting the height of said machine axis relative to said frame;
whereby said machine axis can be adjusted to substantially the height of the joint axis of the user's knee when the user is in either said sitting or said standing position.

2. Apparatus for exercising primarily either the hamstring or quadricep muscle groups of a user, comprising:
a frame;
means for locating at least one knee of a user relative to said frame, said locating means being mounted to said frame for rotation from a first substantially horizontal condition for supporting the posterior portion of the associated thigh of the user in a sitting position to a second substantially vertical condition for bracing the anterior portion of the thigh in a standing position; and
means for engaging the lower leg of the user below the knee and resisting pivotal movement of the lower leg thereabout in a direction outwardly and upwardly relative to said frame, said engaging and resisting means including:
at least one arm engageable with the lower leg of the user; and
means for suspending said arm for pivotal movement about a first horizontal axis substantially parallel to the joint axis of the knee, said suspending means including means for adjusting the height of said first axis relative to said frame;
whereby said first axis of said arm can be adjusted to substantially the height of the joint axis of the user's knee when the user is in either said sitting or said standing position.

3. Apparatus for connection to a pulley station of a weight resistance exercise machine to exercise primarily either the hamstring or quadricep muscle groups of a user, comprising:
a frame mountable to a weight resistance exercise machine;
means for locating at least one knee of a user relative to said frame, said locating means being mounted to said frame for rotation from a first condition for supporting the posterior portion of the associated thigh of the user in a sitting position to a second condition for bracing the anterior portion of the thigh in a standing position; and
means for engaging the lower leg of the user below the knee during movement of the lower leg thereabout in a direction outwardly and upwardly relative to said frame, said engaging means including:
at least one arm engageable with the lower leg of the user; and
means for suspending said arm for pivotal movement about a first axis substantially parallel to the joint axis of the knee, said suspending means including means for adjusting the height of said first axis relative to said frame;
said arm being operatively connectable to a pulley station of the exercise machine to resist said movement of the lower leg;
whereby said movement of the lower leg can be resisted by said arm, and said first axis of said arm can be adjusted to substantially the height of the joint axis of the user's knee when the user is in either said sitting or said standing position.

4. Apparatus as recited in claim 2 or 3 wherein said locating means is mounted for rotation about a second axis parallel to said first axis of said arm.

5. Apparatus as recited in claim 4 wherein said locating means is rotatable through an angle of approximately ninety degrees between said first and second conditions.

6. Apparatus as recited in claim 4 wherein said arm extends from said first axis a distance approximately equal to the tibial length of a male adult human being falling within the 50th percentile of all male adult human beings from the standpoint of physical size.

7. Apparatus as recited in claim 4 wherein said means for adjusting the height of said first axis relative to said frame comprises means for simultaneously adjusting the height of said axis and the horizontal placement thereof outwardly from said frame, such that said first axis can be adjusted to substantially coincide with the joint axis of the user's knee when the user is in either said sitting or said standing position.

8. Apparatus as recited in claim 7 wherein said means for simultaneously adjusting the height and horizontal placement of said first axis comprises a brace mechanism supporting said arm at said first axis and actuable between at least two conditions of extension in a direction outwardly and upwardly relative to said frame, said conditions of extension corresponding to locations of said first axis which substantially coincide with the joint axis of the user's knee when the user is in said sitting and said standing positions, respectively.

9. Apparatus as recited in claim 8 wherein said direction of extension is inclined outwardly approximately thirty degrees from the vertical.

10. Apparatus as recited in claim 8 wherein said brace mechanism comprises a brace element pivotably engaged with said arm at said first axis and a retaining bracket slidably receiving said brace element, the axis of said bracket being angled outwardly and upwardly relative to said frame.

11. Apparatus as recited in claim 10 wherein a portion of said arm is curved through an angle of over ninety degrees adjacent said first axis, said curved portion extending generally outwardly from said first axis and curving generally downwardly therefrom to eliminate the possibility of pinching a user's hand between said arm and said brace element when the height of said first axis is being adjusted.

12. Apparatus as recited in claim 4 wherein said locating means includes at least one thigh pad engageable with the anterior portion of at least one thigh of the user when the locating means is in said second condition, the lower edge of said thigh pad being proximal to the patella of the user's knee.

13. Apparatus as recited in claim 12 wherein said locating means comprises a seat bottom engageable with the posterior portion of at least one thigh of the user when the locating means is in said first condition, said seat bottom being on the opposite side of said locating means from said at least one thigh pad.

14. Apparatus as recited in claim 4 wherein said locating means comprises a seat bottom engageable with at least one thigh of a user when the locating means is in said first condition, said apparatus further comprising a seat back arrangement adjustable fore and aft between a plurality of conditions to provide back support to users of different femur lengths.

15. Apparatus as recited in claim 14 wherein said seat bottom and said seat back comprise a seat assembly which is angled backwardly when said locating means is in said first condition, elevating at least one knee of a user to permit a wide range of motion of said knee.

16. Apparatus as recited in claim 2 wherein said means for adjusting the height of said first axis comprises a brace element pivotably engaged with said arm at said first axis, and a retaining bracket fixed to said frame below said locating means and slidably receiving said brace element in a plurality of different conditions of extension; and said engaging and resisting means comprises a pulley station of an exercise machine having a flexible, elongated force transmitting member connected to said arm; said retaining bracket being offset laterally from said pulley station a preselected distance to prevent interference of said retaining bracket with said force transmitting member.

17. Apparatus as recited in claim 16 wherein said force transmitting member is adjustable in length to permit adjustment of the operative range of pivotal motion of said arm.

* * * * *

UNITED STATES PATENT AND TRADEMARK OFFICE

CERTIFICATE OF CORRECTION

PATENT NO. : 4,358,108

DATED : November 9, 1982

INVENTOR(S) : HARVEY C. VORIS

It is certified that error appears in the above-identified patent and that said Letters Patent are hereby corrected as shown below:

Column 7, line 67, "force" should be --fore--.

Signed and Sealed this

*Twelfth* Day of *April 1983*

[SEAL]

*Attest:*

GERALD J. MOSSINGHOFF

*Attesting Officer*

*Commissioner of Patents and Trademarks*